US009981174B1

(12) United States Patent
Decilveo et al.

(10) Patent No.: US 9,981,174 B1
(45) Date of Patent: May 29, 2018

(54) FRONT TOSS MACHINE

(71) Applicants: Timothy Joseph Decilveo, Los Angeles, CA (US); Alexander Paul Decilveo, Highland Park, NJ (US)

(72) Inventors: Timothy Joseph Decilveo, Los Angeles, CA (US); Alexander Paul Decilveo, Highland Park, NJ (US)

( * ) Notice: Subject to any disclaimer, the term of this patent is extended or adjusted under 35 U.S.C. 154(b) by 0 days. days.

(21) Appl. No.: 15/782,092

(22) Filed: Oct. 12, 2017

(51) Int. Cl.
*A63B 69/40* (2006.01)
*A63B 69/00* (2006.01)
*A63B 102/18* (2015.01)

(52) U.S. Cl.
CPC ..... *A63B 69/408* (2013.01); *A63B 69/0002* (2013.01); *A63B 69/409* (2013.01); *A63B 2069/0008* (2013.01); *A63B 2069/401* (2013.01); *A63B 2069/402* (2013.01); *A63B 2102/182* (2015.10)

(58) Field of Classification Search
CPC . A63B 69/40; A63B 69/408; A63B 2069/402; F41B 3/03
USPC ..... 124/6, 7, 41.1, 81; 473/422, 451
See application file for complete search history.

(56) References Cited

U.S. PATENT DOCUMENTS 2,815,743 A * 12/1957 Brunderman ..... A63B 69/408 124/36
2,908,266 A * 10/1959 Cooper ..... A63B 69/408 124/41.1
3,406,674 A * 10/1968 Zone ..... A63B 69/408 124/36
3,552,371 A * 1/1971 Kahelin ..... A63B 69/408 124/36
4,033,318 A * 7/1977 O'Grady ..... A63B 69/408 124/36
4,269,162 A * 5/1981 Abraham ..... A63B 69/408 124/41.1
4,391,264 A * 7/1983 Abraham ..... A63B 69/408 124/36
4,409,953 A * 10/1983 Kennedy ..... A63B 69/408 124/36
4,860,717 A * 8/1989 Powell ..... A63B 69/408 124/17
4,906,001 A * 3/1990 Vaughn ..... A63B 69/0075 124/36
5,121,735 A * 6/1992 Hancock ..... A63B 69/408 124/41.1
5,439,212 A * 8/1995 Hart ..... A63B 69/408 124/7
5,660,386 A * 8/1997 Krieger ..... A63B 69/407 124/7
5,975,527 A * 11/1999 Winchester ..... A63B 69/408 124/36

(Continued)

FOREIGN PATENT DOCUMENTS

JP 2005204759 A 8/2005

*Primary Examiner* — Alexander Niconovich
(74) *Attorney, Agent, or Firm* — Lynch LLP

(57) ABSTRACT

Systems and methods of ball tossing machines. Ball tossing machines having reconfigurable joints are contemplated. Embodiments having dynamically articulating joints create tossing arms that mimic human arms completing underhanded tosses. In other embodiments, the tossing arm's elbow and fingers can be locked into place and pivoted about a shoulder to accomplish a basic tossing motion with an altered effective tossing arm length.

11 Claims, 5 Drawing Sheets

(56) References Cited

U.S. PATENT DOCUMENTS

| | | | | |
|---|---|---|---|---|
| 7,628,147 | B2 * | 12/2009 | Estalella | A63B 69/407 124/16 |
| 7,806,788 | B1 * | 10/2010 | Neuman | A63B 69/408 124/4 |
| 8,984,736 | B2 * | 3/2015 | Radocy | A61F 2/588 269/71 |
| 9,555,307 | B1 | 1/2017 | Lewis | |
| 2016/0096095 | A1 * | 4/2016 | Williams | A63B 69/0091 124/5 |
| 2016/0250536 | A1 * | 9/2016 | Hart | A63B 69/40 124/7 |

* cited by examiner

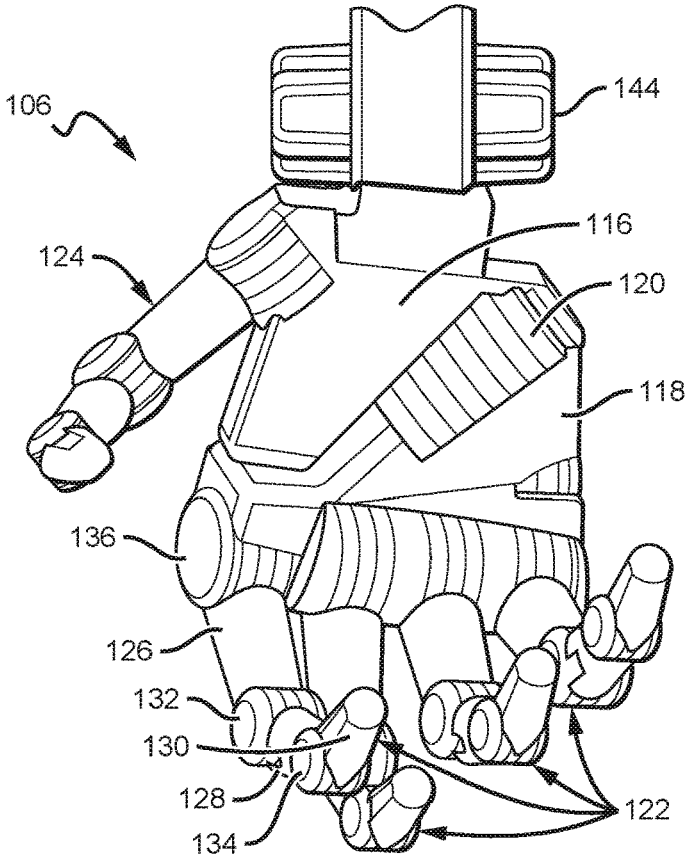
FIG. 3
FIG. 4
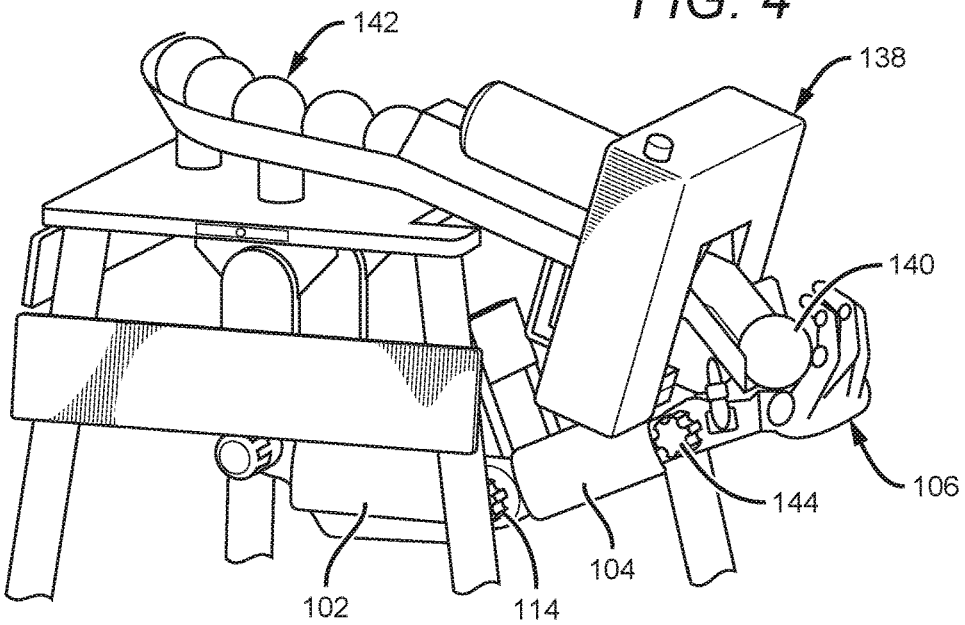

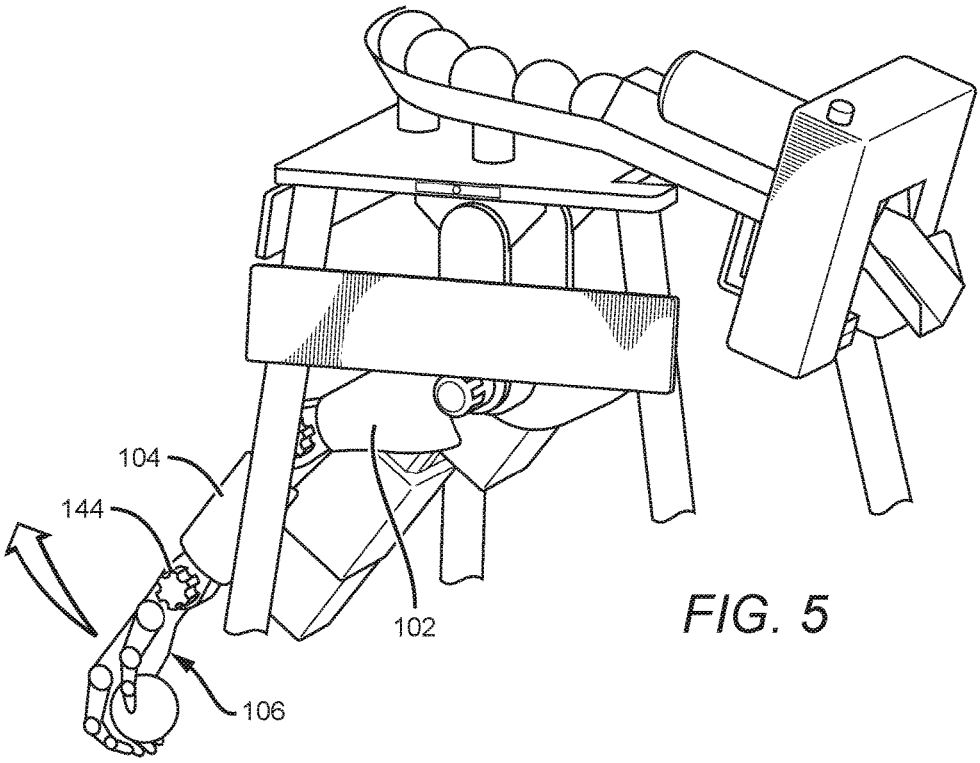
FIG. 5
FIG. 6
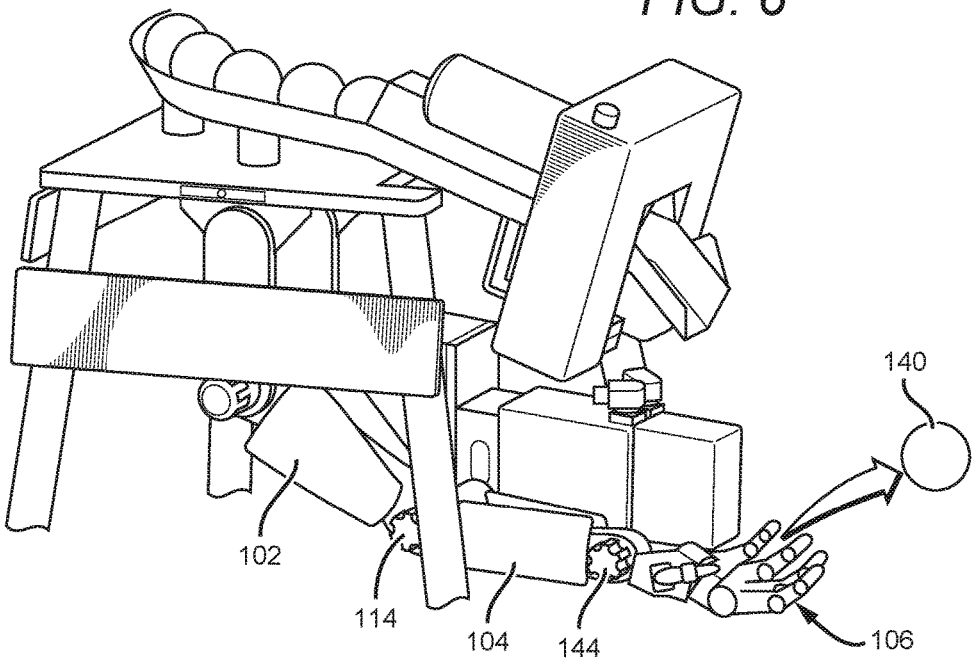

FRONT TOSS MACHINE

FIELD OF THE INVENTION

The field of the invention is ball tossing machines.

BACKGROUND

The background description includes information that may be useful in understanding the present invention. It is not an admission that any of the information provided in this application is prior art or relevant to the presently claimed invention, or that any publication specifically or implicitly referenced is prior art.

Machines that throw balls are not new. U.S. Pat. No. 2,815,743, which issued on Dec. 10, 1957, is an early testament to the enduring innovation in this field. The '743 patent describes an early ball-tossing machine. Since the time of the '743 patent, many other inventors have developed their own iterations of a ball-tossing machine.

For example, U.S. Pat. No. 4,409,953, which issued on Oct. 18, 1983, describes a ball tossing machine that incorporates an underhanded swinging motion. But the '953 patent fails to appreciate advances in technology that make new types of pitching machines viable.

In the past few years, inventors have continued the decades-long effort to improve ball throwing technology. For example, U.S. Patent Appl. No. 2016/0250536 is directed to an overhand pitching machine. The '536 application, like the '953 patent and the '743 patent, fails to appreciate improvements in technology that facilitate the creation of ball throwing machines that can better mimic a natural toss.

These and all other extrinsic materials discussed in this application are incorporated by reference in their entirety. Where a definition or use of a term in an incorporated reference is inconsistent or contrary to the definition of that term provided in this application, the definition of that term provided in this application applies and the definition of that term in the reference does not apply.

It has yet to be appreciated that ball tossing machines can be created to better mimic a human toss.

SUMMARY OF THE INVENTION

The present invention provides apparatus, systems, and methods of a ball tossing machine.

In one aspect of the inventive subject matter, a ball tossing machine is contemplated. Ball tossing machines of the inventive subject matter include a tossing arm having a first lever arm configured to rotate about a shoulder joint, a second lever arm configured to rotate about an elbow joint, and, in some embodiments, a hand comprising at least two digits. It is contemplated that the hand is configured to rotate about a wrist joint. The first lever arm is sized and dimensioned to couple with the second lever arm by the elbow joint, and the second lever arm is sized and dimensioned to couple with the hand by the wrist joint.

In some embodiments, the wrist joint is sized and dimensioned to couple with the fingers. It is contemplated that each finger can include at least one lever arm (e.g., analogous to a finger segment). The hand can additionally include a palm, where the fingers are sized and dimensioned to couple with the palm, and the palm is sized and dimensioned to couple with the wrist joint. In some embodiments, a motor is coupled to the tossing arm.

In another aspect of the inventive subject matter, another ball tossing machine is contemplated. It includes: a tossing arm having a first lever arm coupled to a shoulder joint, a second lever arm coupled to an elbow joint, and a hand coupled to a wrist joint, the hand comprising a palm, a first finger, a second finger, and a thumb. In some embodiments, the wrist joint provides a wrist coupling between the second lever arm and the hand. In some embodiments, the elbow joint provides an elbow coupling between the first lever arm and the second lever arm.

In some embodiments, the wrist joint includes a pivoting joint to facilitate rotation about a fixed axis. The wrist joint can additionally or alternatively include a pivoting joint that is coupled with a rotating joint to facilitate simultaneous rotation about two fixed axes. It is contemplated that the thumb can include several segments, similar to human thumbs. In some embodiments, the thumb pivots toward fingers, and the fingers pivot toward the thumb to clasp a ball in the hand.

In another aspect of the inventive subject matter, a method of using a ball tossing machine with a ball is contemplated. The method can include the steps of: (1) pivoting a first lever arm about a shoulder joint; (2) pivoting a second lever arm about an elbow joint, wherein the second lever arm is coupled with the first lever arm by the elbow joint; (3) opening a hand to receive the ball, the hand comprising a finger and a thumb; and (4) closing the hand around the ball by pivoting the finger and the thumb to clasp the ball.

In some embodiments, the step of opening the hand to receive the ball includes increasing the distance between the finger and the thumb by pivoting at least one of the finger and the thumb. It is contemplated that the step of closing the hand around the ball can include decreasing the distance between the finger and the thumb by pivoting at least one of the finger and the thumb.

In some embodiments, additional steps can also be included: (1) pivoting the first lever arm about the shoulder joint to draw the first lever arm back; (2) pivoting the second lever arm about the elbow joint to at least partially straighten the second lever arm relative to the first lever arm, wherein the second lever arm is coupled with the first lever arm by the elbow joint; (3) swinging, about the shoulder joint, the first lever arm forward; (4) pivoting, about the elbow joint, the second lever arm relative to the first lever arm; and (5) opening the hand to release the ball.

In some embodiments, the hand further comprises a palm that is coupled with the second lever arm by a wrist joint. In these embodiments, the method can include the step of pivoting the hand about the wrist joint. The step of opening the hand to release the ball can include pivoting at least one of the thumb and the finger.

One should appreciate that the disclosed subject matter provides many advantageous technical effects including creating a more natural throwing motion. This more natural throwing motion allows the trajectory of the tossed ball to better simulate the trajectory of a ball tossed by a human. This more natural throwing motion also facilitates improved activities like batting practice for baseball and softball players.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 3 shows the hand of the ball tossing machine shown in FIGS. 1 & 2.

FIG. 4 shows a hand grabbing a ball from a dispenser.

FIG. 5 shows the arm cocked back prior to throwing a ball, with a ball clasped in the hand.

FIG. 6 shows the ball out if the hand, the hand open to release the ball, and the tossing arm in a forward position having just thrown a ball.

DETAILED DESCRIPTION

Figure 1:
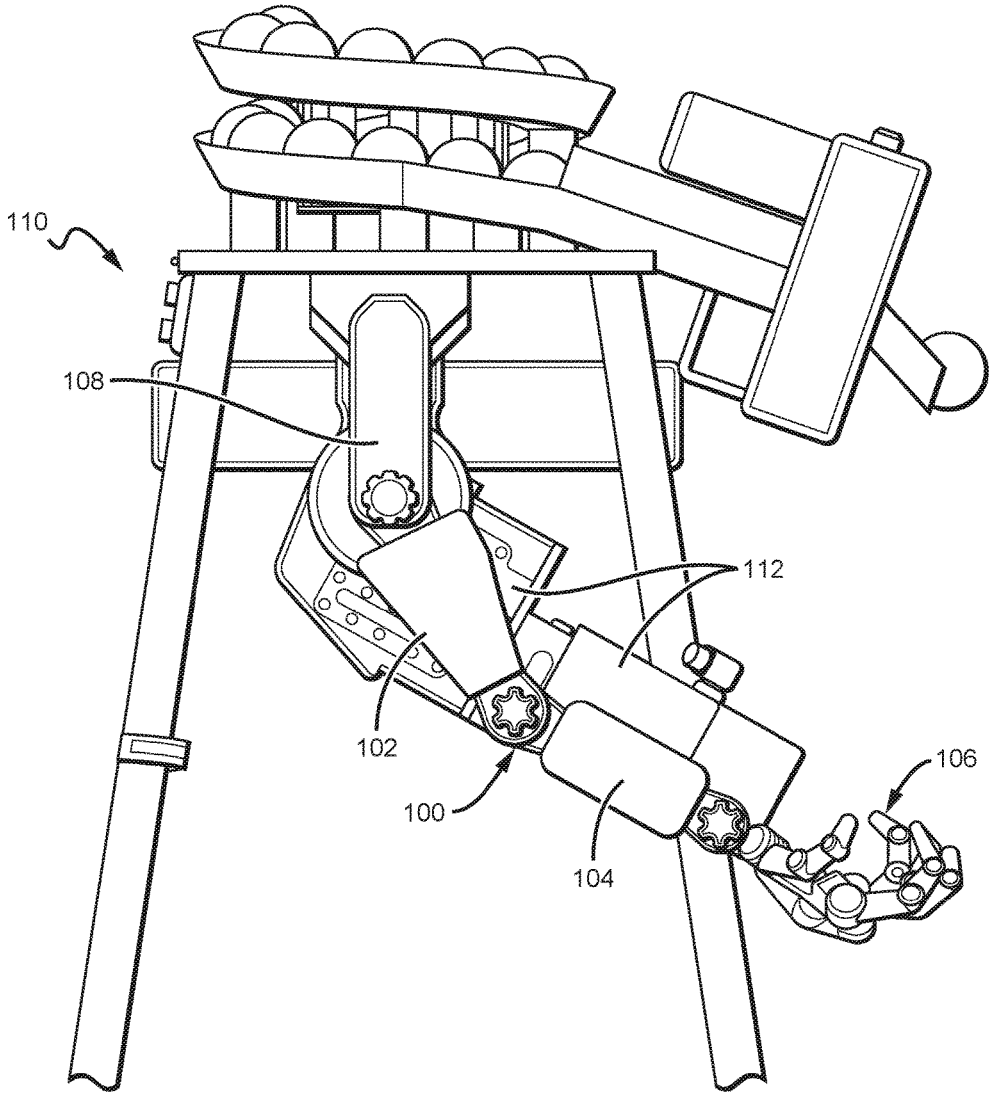
FIG. 1 is a side view of an embodiment of a ball tossing machine.

The following discussion provides example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used in the description in this application and throughout the claims that follow, the meaning of "a," "an," and "the" includes plural reference unless the context clearly dictates otherwise. Also, as used in the description in this application, the meaning of "in" includes "in" and "on" unless the context clearly dictates otherwise.

Also, as used in this application, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth in this application should be interpreted as being inclusive of their endpoints and open-ended ranges should be interpreted to include only commercially practical values. Similarly, all lists of values should be considered as inclusive of intermediate values unless the context indicates the contrary.

It should be noted that any language directed to a computer should be read to include any suitable combination of computing devices, including servers, interfaces, systems, databases, agents, peers, Engines, controllers, or other types of computing devices operating individually or collectively. One should appreciate the computing devices comprise a processor configured to execute software instructions stored on a tangible, non-transitory computer readable storage medium (e.g., hard drive, solid state drive, RAM, flash, ROM, etc.). The software instructions preferably configure the computing device to provide the roles, responsibilities, or other functionality as discussed below with respect to the disclosed apparatus. In especially preferred embodiments, the various servers, systems, databases, or interfaces exchange data using standardized protocols or algorithms, possibly based on HTTP, HTTPS, AES, public-private key exchanges, web service APIs, known financial transaction protocols, or other electronic information exchanging methods. Data exchanges preferably are conducted over a packet-switched network, the Internet, LAN, WAN, VPN, or other type of packet switched network. The following description includes information that may be useful in understanding the present invention. It is not an admission that any of the information provided in this application is prior art or relevant to the presently claimed invention, or that any publication specifically or implicitly referenced is prior art.

Embodiments of the inventive subject matter are directed to the general idea that a ball tossing machine can be made to better approximate the natural movements of a human thrower. Because embodiments of the inventive subject matter are built to approximate the movement of a human arm, some embodiments include components that are analogous to many of the parts of a human arm, including: an upper lever arm approximating an upper arm, a lower lever arm approximating a lower arm, and a mechanical hand having some combination of fingers and, in some embodiments, thumbs. Each of these components are coupled together by joints of various types, to be discussed in more detail below. The term "digit" encompasses both "finger," and "thumb," and can be used interchangeably with those two. The terms "finger" and "thumb" are used for convenience of description and are not meant to imply any functional difference between a "finger" and a "thumb," although it is not a requirement that all of the digits in a particular embodiment are the same as each other.

Figure 2:
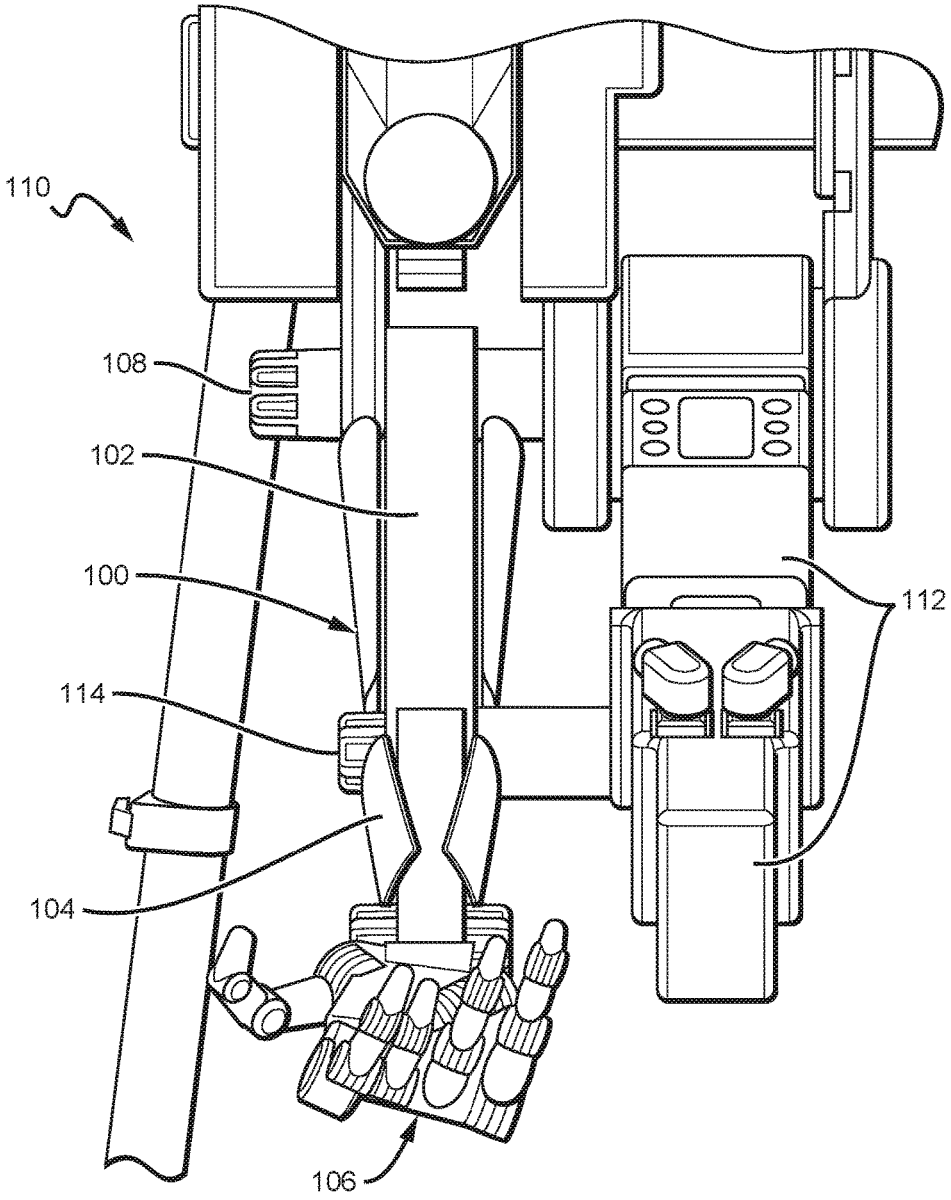
FIG. 2 is a front view of a ball tossing machine.

FIGS. 1 & 2 show a tossing arm 100 of the inventive subject matter, where the tossing arm 100 has an upper arm 102, a lower arm 104, and a hand 106. An upper arm 102 of the inventive subject matter can be seen in FIGS. 1 & 2. FIG. 2 is the same as FIG. 1, but shown at a slightly different angle to make it easier to see some of the various components of the tossing arm.

The upper arm 102 couples with a shoulder joint 108. The upper arm 102 is a rigid lever arm that is primarily responsible for causing the tossing arm 100 to pivot relative to the structure 110 that the tossing arm 100 connects to. The shoulder joint 108 connects to that structure 110, allowing the tossing arm 100 to rotate about a fixed axis. Rotational motion and all other movements of the tossing arm 100 can be caused by one or more drivers (e.g., an electric motor, a hydraulic system, or a pneumatic system). In preferred embodiments, one or more electric motors are implemented and controlled by a system controller that is programmed to facilitate ball tossing.

In some embodiments, the driver is located in the shoulder joint itself, but it is also contemplated that the driver can be located primarily (or entirely) outside of the shoulder joint, e.g., adjacent to the tossing arm, or within the structure or the tossing arm. In some embodiments, the driver is contained within the elbow joint itself, but in other embodiments, the driver is located in or adjacent to the lower arm, in or adjacent to the upper arm, or even within or adjacent to the structure. In embodiments where the driver is not built into the elbow joint itself, mechanical linkages or other components sufficient to transfer mechanical energy (e.g., hydraulics, pneumatics, or shafts with accompanying gearing) from a first location to the elbow can be implemented. In FIGS. 1 & 2, drivers for the entire tossing arm 100 are contained within a driver housing 112, which is separate from the tossing arm 100 itself.

It should be understood that when reference is made to the pivoting of various components relative to other components, these pivots are effected by the drivers, unless explicitly stated otherwise (e.g., manual positioning).

Coupled with the upper arm 102, in some embodiments, is a lower arm 104. The lower arm 104 is another lever arm that couples with the upper arm 102 by an elbow joint 114. The elbow joint facilitates rotation about a fixed axis relative to the upper arm. It is contemplated that the lower arm 104 can be independently caused to move. For example, the lower arm 104 can be caused to rotate about the elbow joint 114 by a driver (e.g., an electric motor, a pneumatic system, or a hydraulic system contained within driver housing 112).

It is contemplated that the lower arm 104 can be held in a fixed position (e.g., a fixed angle) relative to the upper arm 102. In some embodiments, the elbow joint 114 can be manually tightened to fix the lower arm 104 relative to the upper arm 102 (e.g., by hand-tightening the elbow joint 114), while in other embodiments, a locking mechanism can be implemented in the elbow joint 114 to accomplish the same result. For example, the elbow joint 114 can be held in a fixed position (e.g., holding the lower arm 104 in a fixed position relative to the upper arm 102) by either a locking or tightening mechanism, or by an alternative locking mechanism internal or external to the elbow joint 114 (e.g., a solenoid, a ratcheting mechanism, etc.). It is contemplated that the lower arm 104 can be held at any angle between 0 (or near-zero, and similar to a person pulling their forearm to their bicep) and 180 degrees (arm completely straight) to change the effective length of the tossing arm 100.

By including an elbow joint 114 that can fix the lower arm 104 in place relative to the upper arm 102, the effective tossing arm length (e.g., the distance between the hand/ball and the shoulder joint) can be adjusted quickly and easily.

The ability to adjust an effective tossing arm length opens many different possibilities. Because of the relationship between rotational velocity and lever arm length (i.e., velocity equals rotational velocity multiplied by arm length), by having a longer effective tossing arm length with the same rotation speed, a ball can be thrown faster.

In some embodiments of the inventive subject matter, a hand is also included. FIG. 3 shows an embodiment of the hand 106, which is also seen in FIGS. 1 & 2. This hand 106 shows a palm made up of two components, a left side 116 and a right side 118, which are coupled by a hinge component 120. In some embodiments, the hinge component 120 is coupled with a driver (e.g., within the hinge, or elsewhere, with mechanisms to transfer mechanical energy to the hinge component) to facilitate pivoting about the hinge component 120 to better mimic the actions of a human hand. In other embodiments, the palm 116 & 118 is made up of a single piece, which would be the same as fixing the hinge component 120 shown in FIG. 3 in place (e.g., preventing the left side 116 and the right side 118 from rotating relative to one another).

Hands of the inventive subject matter can include several different numbers of digits. The hand shown in FIG. 3 includes a human-like hand 106 having five digits: four fingers 122 and a thumb 124. The hand 106 is coupled with the lower arm 104 by a wrist joint 144. Each of the four fingers 122 includes three segments 126, 128, & 130 that are joined by two knuckles 132 & 134, and each digit is also coupled with the palm 116 & 118 by an additional knuckle joint 136. The thumb 124 shown in FIGS. 1-3 has the same structure as the fingers 122, but it is not necessary that the thumb 124 structure be the same as the fingers 122. In some embodiments, each knuckle and joint related to the fingers can provide for a single degree of freedom (e.g., rotation about a fixed axis), but it is additionally contemplated that each of the joints related to the fingers can include additional degrees of freedom up to six, depending on the needs of the particular embodiment. Moreover, it is contemplated that digits can be configured to have anywhere between 1 and 5 segments.

All of the joints and knuckles contemplated in this application can be configured to facilitate movement with anywhere from one to six degrees of freedom. In this application, a "knuckle" is a joint by a different name for the sake of clarity in writing.

It is additionally contemplated that, in some embodiments, instead of including a palm, the fingers and thumb can couple with the lower arm. In these embodiments, there would be no need for a wrist joint, and instead, movement of the digits can be accomplished by virtue of their joints coupling with the lower arm where the wrist would otherwise be located. This can be preferable in embodiments where simplicity is more important than more precisely mimicking a human arm's tossing movements.

Digits can be manipulated and controlled by drivers, similar to the other lever arms associated with the tossing arm. For example, small motors can be implemented in the digits themselves to control the movements of the different segments of each digit. In some embodiments, drivers to control the digits are located away from the digits themselves. For example, in some embodiments, the digits can be pneumatically or hydraulically controlled, which allows for high pressure lines to run from any location in the ball tossing system to any other location, including the digits. Causing movement through these modes (e.g., transferring mechanical energy from one location to another via, for example, hydraulic or pneumatic systems) can be beneficial where reduction of weight and bulk in the hand is preferable. Thus, each segment of each digit can be controlled independently and, in some embodiments, from a driver that is located away from the hand portion.

The ball throwing system can perform several actions, including: grabbing a ball, pulling the arm back to throw a ball, and throwing a ball. Each of these actions will be described in more detail below in association with relevant figures.

Before a throw can be accomplished, a ball must first be grabbed. As shown in FIG. 4, the upper arm 102 pivots forward (e.g., toward the ball dispenser) about the shoulder joint 108 so that the hand 106 can receive a ball 140. Balls are held in a hopper 142 that is positioned so that it can feed balls into the hand 106 on demand. To align the hand 106 with the ball dispenser 138 it is contemplated that the lower arm 104 can also pivot relative to the upper arm 102 about the elbow joint 114, and the hand 106 can pivot relative to the lower arm 104 about the wrist joint 144. Rotation about the elbow joint 114 and the wrist joint 144 can occur either clockwise or counterclockwise, depending on the configuration of the tossing arm 100 and based on efficiency of movements to set the tossing arm 100 up to pull back for a throw.

When the hand 106 is brought to where the balls are dispensed from, the hand 106 must then move to receive a ball 140. Because hands of the inventive subject matter approximate human hands by including digits (and, in some embodiments, a palm that couples with the lower arm by a wrist joint), the hand 106 must open to receive a ball.

Because of the numerous joints (e.g., the knuckles of the digits, the wrist, the joint across the palm, etc.), the action of opening and receiving a ball can be accomplished in many different ways. In some embodiments, the hand 106 is brought to the ball dispenser 138 and the various levers (e.g., the upper arm 102, the lower arm 104, the hand 106, the digits 122, and so on) are positioned such that the palm 116 & 118 is facing up toward the ball, and then the digits 122 & 124 on the hand are opened so that the tips of the digits move away from each other sufficiently for a ball to be dropped into the open hand 106. The exact sequence of joint movements and angles is subject to near-endless variability. In some embodiments, as discussed above, the elbow joint 114 is manually fixed so that the lower arm 104 is in a fixed position relative to the upper arm 102.

A ball 140 is then dropped into the open hand 106. The presence of a ball 140 in the hand 106 can be determined, for example, by a pressure sensor in the palm 116 & 118, by reading back EMF from electric drivers indicative of a load on any of the joints in the system, by visual detection (e.g., using a camera or any other sensor capable of detecting electromagnetic radiation), or by detecting that a ball 140 has left the dispenser 138 (e.g., visually or by pressure sensing). Once it is determined that a ball 140 is held in the hand 106, the digits 122 & 124 then clasp the ball 140. In embodiments where the palm includes two components with a hinge between the two, the left side of the palm 116 and the right side of the palm 118 can also pivot inward toward the ball 140 to create a better grip on the ball 140 when it is in the palm of the hand 106.

With a ball 140 held in the hand 106, the tossing arm 100 then repositions to pull the arm back in preparation of a throw, as shown in FIG. 5. To prepare for a throw, each of the different lever arms can be repositioned to different angular positions relative to the other lever arms. For example, the upper arm 102 can swing back, while the lower arm 104 can straighten out (e.g., entirely or partially) relative to the upper arm 102. The hand 106 can likewise pull back (e.g., pivot about the wrist 144 so that the back of the hand 106 pivots toward the lower arm 104). By moving to these positions before a throw, the tossing arm 100 can better imitate a human arm.

Finally, the tossing arm 100 then begins a tossing movement and throws a ball 140 as shown in FIG. 6. To toss a ball 140, the tossing arm 100 undergoes several positional changes. Most importantly, the upper arm 102 pivots forward to swing the tossing arm 100 forward in an underhand motion. In some embodiments, the lower arm 104 can also swing forward, pivoting about the elbow joint 114. In addition, the hand 106 can pivot about the wrist joint 144 to facilitate a throw. The final step is for the hand 106 to open to release the ball 140 for a toss.

Opening the hand 106 to release the ball for a toss can be accomplished in many different ways, depending on the type of toss to be accomplished. In embodiments of the device with dynamic digits (e.g., digits can be moved or adjusted by drivers during the action of tossing a ball), some digits can move differently from others to cause the ball to be thrown in different ways. For example, the index finger can "flick" forward (e.g., move quickly forward relative to the other fingers) at the same time that the thumb releases, allowing the ball to roll off the fingers. By flicking one or more fingers on either side of the hand in a quick, coordinated way, the ball can be caused to spin. In the same way, the fingers can release the ball in such a way that the ball does not spin at all, depending on the needs of a user. When the ball is released, it arcs forward for a user to swing at with a sporting implement (e.g., a racket, a bat, etc.).

Throwing machines of the inventive subject matter can be used in stage 2 baseball hitting practice. The throwing machine is preferably placed between 5 and 40 feet from the batter so it can toss a ball into the batter's hit box at a speed between 3 MPH and 25 MPH.

It is additionally contemplated that is it not necessary for the ball to ever be fully clasped by the digits in the first place. For example, the hand can create a cradle that the ball rests in by the force of gravity, and it is released by the swinging of the arm and, in some embodiments, a combination of a pivot in the wrist joint to allow the ball to roll from the cradle across the digits. This does not preclude the digits from also moving to affect the toss, but in these embodiments, the thumb is not necessary and no clasping is needed. In other embodiments, no thumb is necessary and the digits are long enough to clasp a ball by curling around the ball sufficiently to grasp it.

Figure 7:
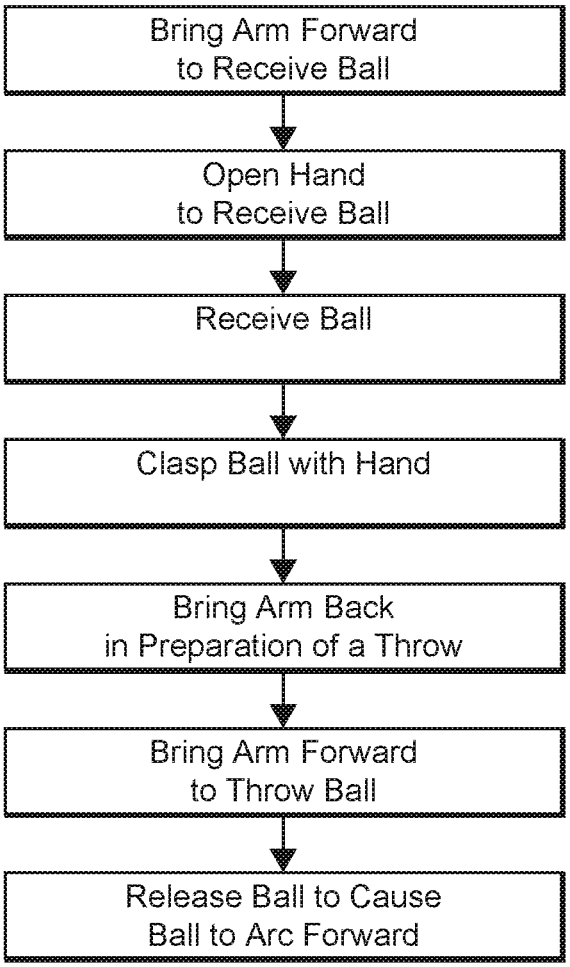
FIG. 7 is a flow chart describing the steps undertaken by an embodiment of a pitching device.

This sequence of actions described above is shown in FIG. 7. It is contemplated that each of the actions shown in FIG. 7 is understood to encompass all of the different details described in relation to those actions above (e.g., subtle movements of the lower arm relative to the upper arm, digit movements, wrist movements, etc.).

In some embodiments, the fingers are static (e.g., they do not have associated joints, or the joints are fixed in place relative to one another and relative to the hand). These embodiments enjoy simplicity of construction since there is no need to deliver mechanical energy to individual digits. In these embodiments, the thumb can pivot and reposition to enable the hand to receive and to clasp a ball, and also to release to throw the ball.

It is additionally contemplated that all of the moveable joints described in this application, save for the shoulder joint, can be manually repositionable, forgoing the need for drivers for those joints. By including these joints without drivers, but with mechanisms to cause the joints to lock in place (e.g., a ratcheting mechanism a pin-based locking mechanism, or any other suitable mechanism to facilitate holding two lever arms in a static angular position relative to each other), a reconfigurable ball throwing machine is contemplated. As mentioned above, one advantage to a locking elbow joint is that systems of the inventive subject matter can have varying effective tossing arm lengths.

It is contemplated that the different lever arms of the inventive subject matter can be spring-biased. For example, the "resting" position of the tossing arm can be fully forward (e.g., as if the arm had just tossed a ball). Thus, when the arm is pulled back, instead of requiring a driver to swing the arm forward, the spring can cause the arm to swing forward. Springs that can accomplish this include, for example, a torsion spring coupled with the shoulder joint. Spring-biases can be incorporated into any of the joints described in this application.

Thus, specific systems, methods, and apparatuses of baseball pitching machines have been disclosed. It should be apparent, however, to those skilled in the art that many more modifications besides those already described are possible without departing from the inventive concepts in this application. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A ball tossing machine comprising:

a tossing arm comprising:

a first lever arm configured to rotate about a shoulder joint having a shoulder joint axis of rotation, a second lever arm configured to rotate about an elbow joint having an elbow joint axis of rotation, and a hand comprising at least two fingers, wherein the hand is configured to rotate about a wrist joint having a wrist joint axis of rotation;

wherein the shoulder joint axis of rotation, the wrist joint axis of rotation, and the elbow joint axis of rotation are all substantially parallel to each other;

wherein the first lever arm is sized and dimensioned to couple with the second lever arm by the elbow joint;

wherein the second lever arm is sized and dimensioned to couple with the hand by the wrist joint.

2. The ball tossing machine of claim 1, wherein the wrist joint is sized and dimensioned to couple with the at least two fingers.

3. The ball tossing machine of claim 1, wherein the hand further comprises a palm.

4. The ball tossing machine of claim 3, wherein the at least two fingers are sized and dimensioned to couple with the palm, and the palm is sized and dimensioned to couple with the wrist joint.

5. The ball tossing machine of claim 1, wherein each finger of the at least two fingers comprises at least one lever arm.

6. The ball tossing machine of claim 1, further comprising a motor coupled to the tossing arm.

7. A ball tossing machine comprising:

a tossing arm comprising:

a first lever arm coupled to a shoulder joint having a shoulder joint axis of rotation, a second lever arm coupled to an elbow joint having an elbow joint axis of rotation, and a hand coupled to a wrist joint having a wrist joint axis of rotation, the hand comprising a palm, a first finger, a second finger, and a thumb;

wherein the shoulder joint axis of rotation, the wrist joint axis of rotation, and the elbow joint axis of rotation are all parallel to each other;

wherein the wrist joint provides a wrist coupling between the second lever arm and the hand; and wherein the elbow joint provides an elbow coupling between the first lever arm and the second lever arm.

8. The ball tossing machine of claim 7, wherein the wrist joint comprises a pivoting joint to facilitate rotation about a fixed axis.

9. The ball tossing machine of claim 7, wherein the wrist joint comprises a pivoting joint that is coupled with a rotating joint to facilitate simultaneous rotation about two fixed axes.

10. The ball tossing machine of claim 7, wherein the thumb comprises a first thumb segment and a second thumb segment.

11. The ball tossing machine of claim 7, wherein the thumb pivots toward the first and second fingers, and the first and second fingers pivot toward the thumb to clasp a ball in the hand.

* * * * *